US006585082B1

(12) United States Patent
Harbers, Jr.

(10) Patent No.: US 6,585,082 B1
(45) Date of Patent: Jul. 1, 2003

(54) FIRE ESCAPE METHOD

(75) Inventor: Henry C. Harbers, Jr., Templeton, CA (US)

(73) Assignee: Atoll Holdings Inc., San Luis Obispo, CA (US)

( * ) Notice: Subject to any disclaimer, the term of this patent is extended or adjusted under 35 U.S.C. 154(b) by 0 days.

(21) Appl. No.: 09/883,160

(22) Filed: Jun. 18, 2001

(65) Prior Publication Data

(65)

(51) Int. Cl.[7] ..... A62B 1/06

(52) U.S. Cl. ..... 182/70; 182/71

(58) Field of Search ..... 182/42, 80, 43, 182/78, 79, 70, 71, 73, 76, 77, 48; 254/390, 392, 398, 264, 151

(56) References Cited

U.S. PATENT DOCUMENTS

| | | | | | |
|---|---|---|---|---|---|
| 145,844 | A | | 12/1873 | Chipley | |
| 213,327 | A | | 3/1879 | Foley | |
| 237,316 | A | | 2/1881 | Pinckney | |
| 269,377 | A | | 12/1882 | Bessier | |
| 487,395 | A | | 12/1892 | Mannheim | |
| 652,621 | A | | 6/1900 | LePore | |
| 1,914,889 | A | * | 6/1933 | Lugara | 182/70 X |
| 2,078,146 | A | * | 4/1937 | Le Blanc | 182/76 |
| 2,210,182 | A | * | 8/1940 | Schultz et al. | 182/74 |
| 2,236,019 | A | | 3/1941 | Thompson | |
| 2,840,289 | A | * | 6/1958 | Murray | 182/77 |
| 3,017,956 | A | | 1/1962 | Corlett | |
| 3,847,246 | A | | 11/1974 | Banner | |
| 3,874,632 | A | * | 4/1975 | Rago | 182/42 X |
| 4,520,900 | A | | 6/1985 | Orgeron | |
| 4,919,235 | A | | 4/1990 | DelSavio | |
| 5,064,021 | A | * | 11/1991 | Bauer | 182/73 |
| 5,101,935 | A | * | 4/1992 | La Bianca | 182/42 X |
| 5,303,799 | A | | 4/1994 | Tsai | |
| 5,562,184 | A | * | 10/1996 | Yung-Ho | 182/48 |
| 5,620,058 | A | * | 4/1997 | Forrester | 182/48 |
| 5,785,147 | A | * | 7/1998 | Lee | 182/70 |
| 6,186,276 | B1 | | 2/2001 | Harbers, Jr. | |
| 6,328,129 | B1 | * | 12/2001 | Ferguson | 182/70 |

* cited by examiner

*Primary Examiner*—Daniel P. Stodola
*Assistant Examiner*—Hugh B. Thompson
(74) *Attorney, Agent, or Firm*—William W. Haefliger

(57) ABSTRACT

The method of providing for escape from a building, that includes providing a safety door extending between a passage in the building, and the building exterior, the door extending upwardly from a location proximate the passage floor, supporting the door to open outwardly away from the passage, thereby opening the passage to the building exterior; and providing descent equipment including a cable or cables, for support by the door, and to move outwardly with the door so as to become located above the void below the opened door at the building exterior, whereby a person in the passage may access the descent equipment to be controllably lowered downwardly into the void at the building exterior while supported by the door.

18 Claims, 5 Drawing Sheets

12
40
40a
15
41
19
20
18
11
57
45
30
22
23
27
23a
25
24
26
22a
10
31
13
32
33
16
41
40b 23
23a
11
10
12a
22
24
26
12

FIRE ESCAPE METHOD

BACKGROUND OF THE INVENTION

This invention relates generally to method and means for escaping from a building, at the outer side of the building, and more particularly to provision of a multi-functional door serving when closed to block escape from the building interior at an upper elevation, and when open to suspend a person being lowered to a safe level.

There is continual need for improvements in escape methods and apparatus, enabling a person on an upper floor of the building to safely escape, as in case of fire. This need is acute when a fire prevents downward escape at the building interior, and where there are no fire escape steps attached to the exterior of the building.

SUMMARY OF THE INVENTION

It is a major object to provide a highly useful and simple method and apparatus to enable such escape, and downward travel at the building exterior. Basically, a multi-functional safety door is provided at an upper level or upper floor level of the building, the door located at the side of the building to be swung open for opening the way to escape from the building, and for suspending a person being lowered to safe level. The method includes the steps:

a) providing a safety door extending between a passage in the building and the building exterior, the door extending upwardly from a location proximate the passage floor, b) supporting the door to open outwardly away from the passage, thereby opening the passage to the building exterior, allowing a person to walk out of the passage to the building exterior, c) providing descent equipment including a cable or cables, for support by the door, and to move outwardly with the door so as to become located above the void below the opened door at the building exterior, d) whereby a person in the passage may easily access the descent equipment and may be controllably lowered downwardly in the void at the building exterior, while supported by the door.

It is another object to provide for attachment of the descent equipment to the building occupant before the occupant steps outwardly from the passage into a position above the void.

Yet another object is to provide for hinge attaching the door to a frame, which is in turn attached to the building.

A further object includes providing a safety barrier barring the person against stepping from the passage to the building exterior when the door is in opened condition, until the barrier is moved into non-barring position.

An additional object includes provision of a holder on the door to temporarily support the person at the building exterior, until that person operates the descent equipment. Such a holder may take the form of a hand hold, and/or a foot support, on the door.

The descent equipment may advantageously include a rotor carried by the door for entraining the lowering cable or cables; and a control cable may be provided to be manually operated by the occupant for controlling his descent. A supply of such control cable can be located at the location of the descending person, during the descent.

As will be seen, the safety barrier is located to be initially displaced from barring position to allow the person to step outwardly from the passage, and the barrier is allowed to return to said barring position after the person has stepped outwardly to be supported by the door. After the barrier is displaced from escape barring position, the door is opened to project at a position generally perpendicular to a side of the building, and the door is retained in that position.

The door can also be used to suspend a rescuer to travel upwardly at the building exterior, to a level for rescue of a person seeking to escape from an upper level in the building.

Apparatus providing for escape from a fire in a building comprises:

a) a safety door extending between a passage in the building, and the building exterior, the door extending upwardly from a location proximate the passage floor, b) the door supported to open outwardly away from the passage, thereby opening the passage to the building exterior, allowing a person to walk out of the passage to the building exterior, c) and descent equipment including a cable or cables located to be supported by the door and to become located above the void below the opened door at the building exterior, d) whereby a person in that passage may access the descent equipment, to be controllably lowered downwardly into the void at the building exterior while supported by the door.

In this regard, the descent equipment is typically located to be accessed and attached to that person before that person steps outwardly from said passage into a position above the void.

A further object is to provide means to enable unlocking and opening of different of the escape doors, in a building, said means selected from the group:

i) a smoke responsive or detecting door unlocking control, ii) a manually operated door unlocking control, iii) an electrically responsive door unlocking control.

These and other objects and advantages of the invention, as well as the details of an illustrative embodiment, will be more fully understood from the following specification and drawings, in which:

DRAWING DESCRIPTION

DETAILED DESCRIPTION

Figure 1:
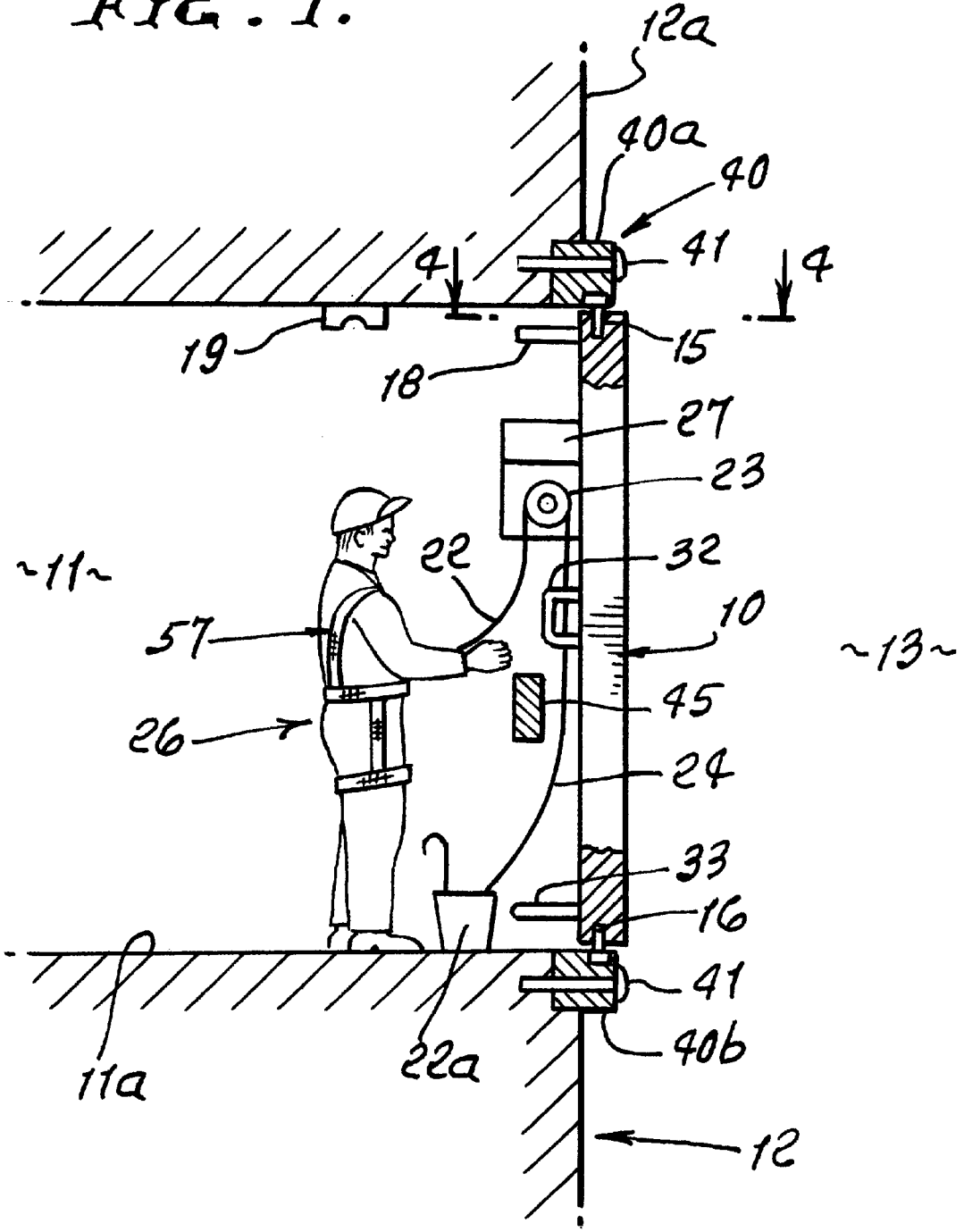
FIG. 1 is a side elevation showing a safety door in closed position.

Referring first to FIG. 1, a safety door 10 is shown in closed position, at the end of a passage 11 in a building 12. The passage also appears in FIGS. 2 and 3. The door closes off the passage from the building exterior 13, and it may extend upwardly from a level at or proximate the passage floor level 11*a*.

Figure 2:
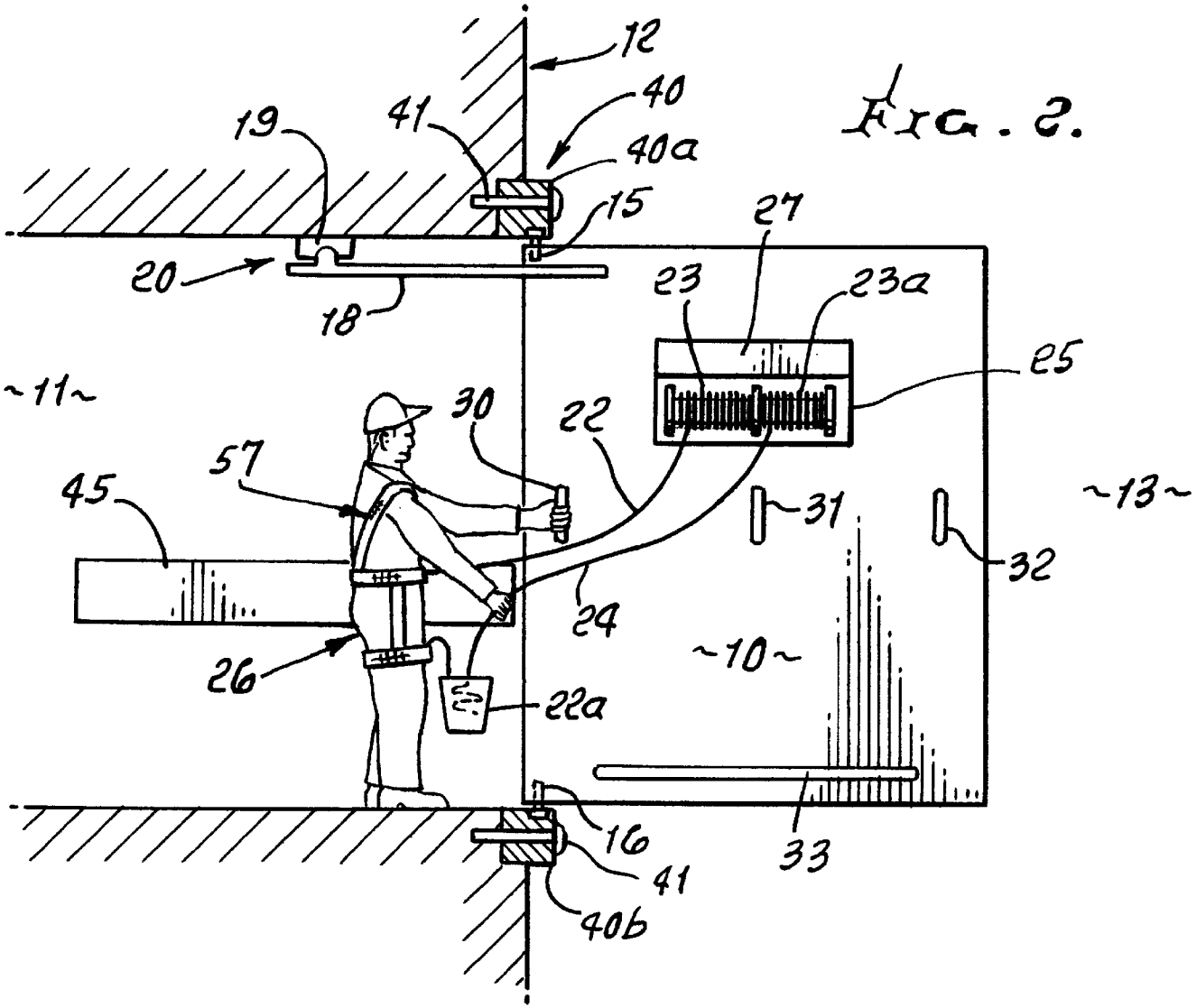
FIG. 2 is a view like FIG. 1, showing the door in open position.
Figure 3:
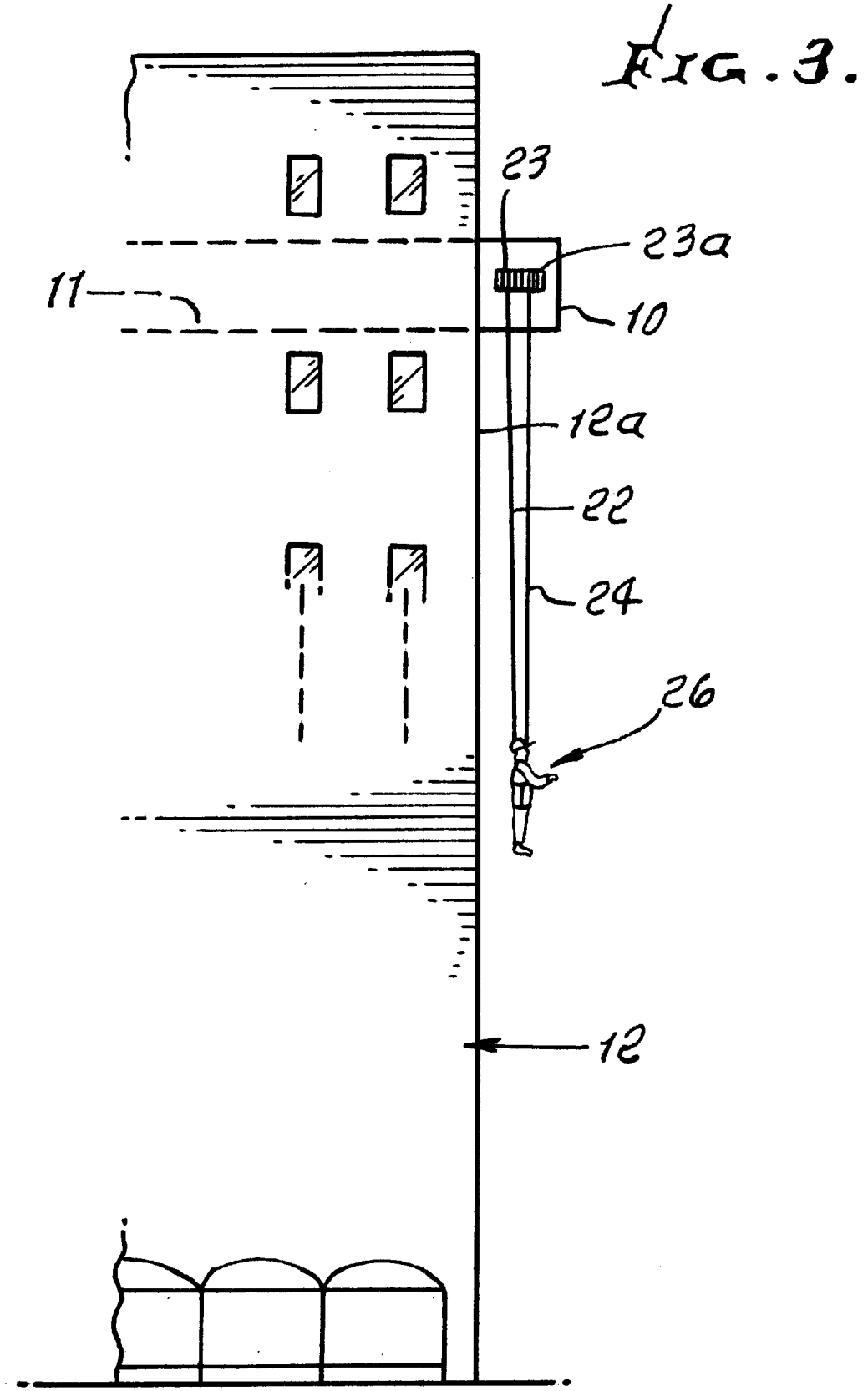
FIG. 3 is an elevation showing descent from a supporting safety door, in open position as in FIG. 2.

The safety door is supported, as by upper and lower hinges 15 and 16, or other means, to open outwardly away from the passage 11, so as to open the passage to the exit and exterior 13. Preferably, the door is opened to a position as seen in FIGS. 2 and 3, projecting in a plane generally perpendicular to the building or to its side 12*a*. The door may be quite heavy, and consist of metal, such as steel. A detent or other holder may be used to hold the door in opened position. See for example detent arm 18 projecting from the door toward and into the passage 11, to interfit a plate 19, at location 20.

Figure 5:
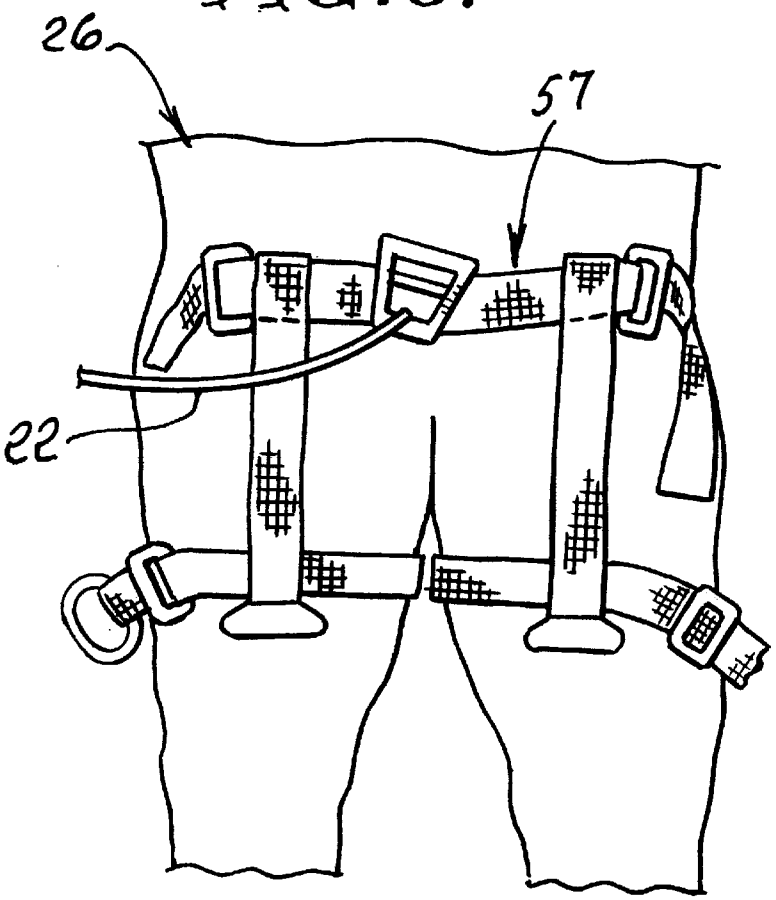
FIG. 5 is a frontal view of cable support of a user, as by a harness.
Figure 4:
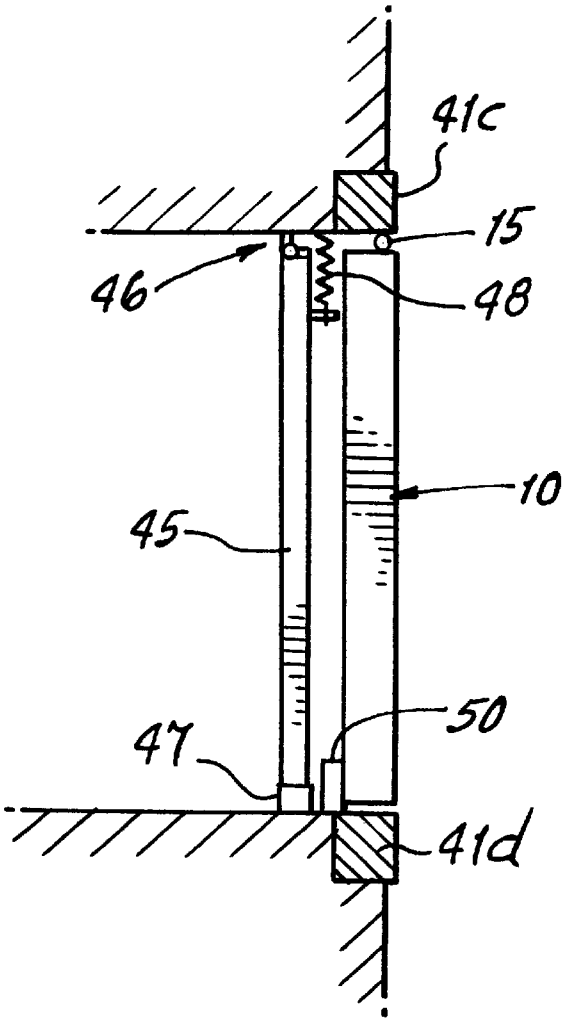
FIG. 4 is a plan view taken on lines 4—4 of FIG. 1.

Descent equipment including a cable or cables, is provided for support by the door, and to move outwardly with the door so as to become located above the void below the opened door, at the building exterior 13. In the example, the descent equipment includes support cable 22 extending from a reel or rotor 23 carried by the door at its inner side, and descent control cable 24 extending from that rotor or from a brake or other means indicated at 23*a,* associated with the rotor or reel, and carried by the door, at 25. Referring to FIG. 2, the user 26 accesses the descent equipment as by first attaching a harness 57 to his body, that harness connected to support cable 22; preferably, such attachment is made before the door is unlocked and pushed open, to FIG. 2 position. One usable harness is shown in FIG. 5.

The harness may be stored at the inner side of the door, as in a container 27, to be readily accessible and attachable to the user's body before the user steps outwardly from the passage to the building exterior and above the descent void.

Hand and foot holds or supports are shown at 30–33, attached to the inner side of the door, for use during such stepping to the building exterior. They enable initial positioning of the descent equipment user in a door supported position, directly below the cable reel 23, from which support cable 22 is payed out, under the control of the control cable, by the user. The control cable may be payed out from a container as at 22*a,* which may be attached to the harness 57. See also FIG. 3, showing the user descending adjacent the building.

One such support and control system is disclosed in my U.S. Pat. No. 6,186,276, incorporated herein by reference.

FIGS. 1 and 2 also show a rectangular door frame 40 attached as by bolts 41 to the building. The door hinges 15 and 16 may be attached to the upper and lower frame members 40*a* and 40*b,* as shown.

Also provided is a safety barrier barring the person against stepping from the passage to the building exterior, when the door is in opened condition, until the barrier is moved into non-barring position. One such barrier is seen at 45 extending horizontally laterally at the rear side of the door, but attached to the frame or the building structure. See FIG. 5 showing hinging of the barrier bar at 46, to swing between blocking position, and unblocking position, and a releasable retainer 47 to hold the barrier in blocking position. A spring 48 may be employed to urge the bar to swing toward blocking position. A door lock is shown at 50.

In summary, the method of providing for escape from an upper level in a building, includes a) providing a safety door extending between a passage in the building, and the building exterior, the door extending upwardly from a location proximate the passage floor, b) supporting the door to open outwardly away from the passage, thereby opening the passage to the building exterior, c) providing descent equipment including a cable or cables, for support by the door, and to move outwardly with the door so as to become located above the void below the opened door at the building exterior, d) whereby a person in that passage may access the descent equipment to be controllably and safely lowered downwardly into the void at the building exterior, while supported by the door.

The invention also contemplates rescue of an occupant wishing to escape from a building, by provision of the following:

a) providing a safety door to be supported by the building, at a side of the building, b) opening the door away from the side of the building to expose an exit from the building, c) supporting rescue equipment from the door, d) suspending a rescuer by the rescue equipment, to travel upwardly into proximity to the door, for rescue of the occupant at said exit, as by lowering of the occupant, with or without the rescuer, using the harness.

The support cable may be used to elevate the rescuer to the level of the opened door, and the rescuer can then assist the escape of the person wishing to be rescued, by employment of a harness to support that person, in the manner described above. The rescuer and the rescued person can then descend together, as by use of separate harnesses, or a shared harness.

Figure 6:
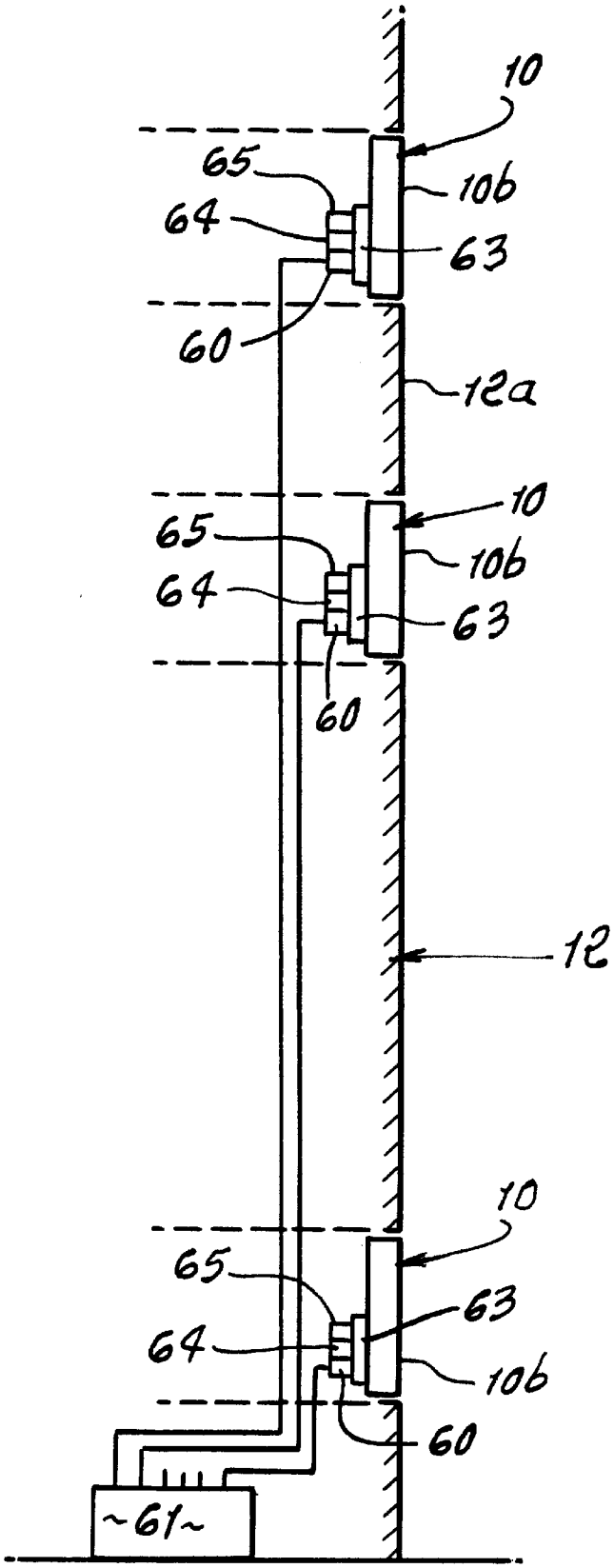
FIG. 6 is a circuit diagram.

FIG. 6 shows a means to enable selective unlocking and opening of different levels in a building. Electrically operated controls to control locks 63 for the doors are indicated at 60; and a master control and circuitry to selectively control the locks is shown at 61. It may, for example, be located at ground level. One advantage is that only those doors at danger level, such as a fire, are enabled to be unlocked, all other safety doors in the building being kept locked.

Smoke responsive controls may be provided, as at 64, to unlock the locks 63, allowing opening of the doors 10.

Manually operated controls may be provided, as at 65, to unlock the locks 63, allowing opening of the doors, irrespective of the controls 60 and 64.

FIG. 6 also shows the closed door outer surfaces 10*b* extending flush, or substantially flush with the building outer surface 12*a*.

I claim:

1. A method of providing for escape from a building, that includes:

a) providing a safety door extending between a passage in the building, and a building exterior, the door extending upwardly from a location proximate a floor of the passage, b) supporting the door to open outwardly away from the building exterior and away from a passage closing door closed position, thereby opening the passage to the building exterior, allowing a person to walk out of the passage to the building exterior, with the door being opened, c) providing descent equipment including a cable or cables, and harness exposed and supported at an inner side of the door, and by the door, for cable movement outwardly with the door so as to become located above a void below the opened door at the building exterior, and near the door at the building exterior, d) whereby a person in the passage may access said descent equipment including said harness before the door is opened, and to become harnessed and then to move outwardly of said passage to be lowered downwardly into the void at the building exterior and below the door while supported by the opened door, e) the door having a frame, and wherein said supporting includes providing hinge attachment of the door to said door frame, which is in turn attached to the building, whereby the door swings outwardly while remaining vertically oriented.

2. The method of claim 1 including attaching said harness to said person before said person steps outwardly from the passage into a position above the void.

3. The method of claim 1 wherein said supporting includes attaching the door to a frame, which is in turn attached to the building.

4. The method of claim 1 including providing a safety barrier barring the person against stepping from the passage to the building exterior when the door is in opened condition, until the barrier is moved into non-barring position.

5. The method of claim 4 including displacing said barrier from barring position to allow the person to step outwardly from the passage, and allowing the barrier to return to said barring position after the person has stepped outwardly to be supported by the door.

6. The method of claim 1 including providing a holder on the door to temporarily support the person at the building exterior, until that person operates said descent equipment.

7. The method of claim 6 wherein said holder is provided in one of the following forms:

i) a hand hold ii) a foot support.

8. The method of claim 1 wherein said descent equipment is provided to include a rotor about which said cable is entrained.

9. The method of claim 8 wherein said cable or cables include a control cable to be manually controlled by the occupant for controlling his descent, and including the step of manipulating said control cable during said descent.

10. The method of claim 9 including supporting and paying out a supply of said control cable at the location of the descending person, during the descent.

11. The method of claim 1 including opening the door to project at a position generally perpendicular to said side of the building, and retaining the door in said position.

12. The method of claim 1 including the step of attaching the harness to the person prior to opening the door.

13. The method of claim 1 including returning the descent equipment back upwardly alongside the building, and into proximity to the door.

14. The method of claim 13 including supporting a rescuer by the descent equipment and door to ascend into proximity to the open door.

15. The method of claim 1 including restraining the door in opened condition during lowering of said person.

16. The method of claim 1 including providing said harness at the inner side of the door, to be accessed and attached to said person and to one of said cables, for support by said one cable during said lowering.

17. A method of rescuing a person wishing to escape from a building, that includes:

a) providing a safety door to be supported by the building, at a side of the building, b) opening the door away from the side of the building to expose an exit from the building, allowing a person to walk out of the passage to the building exterior, the door having a frame, the door supported by providing hinge attachment of the door to said door frame, which is in turn attached to the building, whereby the door swings outwardly while remaining vertically oriented, c) supporting rescue equipment including a safety harness from the door, d) suspending a rescuer by said rescue equipment, to travel upwardly into proximity to the door, for rescue of said person at said exit.

18. The method of claim 17 including providing and locating said safety harness for supporting one of the following:

i) the rescuer, ii) the person wishing to be rescued, iii) both the rescuer and the person wishing to be rescued.

* * * * *